US012628996B2

(12) United States Patent
Hong et al.

(10) Patent No.: US 12,628,996 B2
(45) Date of Patent: May 19, 2026

(54) CLEANER AND METHOD FOR CONTROLLING THE SAME

(71) Applicant: SAMSUNG ELECTRONICS CO., LTD., Suwon-si (KR)

(72) Inventors: Jongsoo Hong, Suwon-si (KR); Jeehoon Kim, Suwon-si (KR); Chunseong Kim, Suwon-si (KR); Byoungwoo Ko, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 188 days.

(21) Appl. No.: 18/234,680

(22) Filed: Aug. 16, 2023

(65) Prior Publication Data

US 2024/0130592 A1 Apr. 25, 2024
US 2024/0225401 A9 Jul. 11, 2024

Related U.S. Application Data

(63) Continuation of application No. PCT/KR2023/010675, filed on Jul. 24, 2023.

(30) Foreign Application Priority Data

Oct. 19, 2022 (KR) ..... 10-2022-0135225

(51) Int. Cl.
*A47L 13/00* (2006.01)
*A47L 11/282* (2006.01)
*A47L 11/40* (2006.01)

(52) U.S. Cl.
CPC ..... *A47L 11/4011* (2013.01); *A47L 11/282* (2013.01); *A47L 11/4002* (2013.01);
(Continued)

(58) Field of Classification Search
CPC A47L 11/4011; A47L 11/282; A47L 11/4002; A47L 11/4038; A47L 11/4069;
(Continued)

(56) References Cited

U.S. PATENT DOCUMENTS 5,424,939 A 6/1995 Kweon
5,613,261 A 3/1997 Kawakami et al.
(Continued)

FOREIGN PATENT DOCUMENTS

JP 3293314 6/2002
JP 2021-503334 2/2021
(Continued)

OTHER PUBLICATIONS

Machine translation of KR-200435130-Y1 (Year: 2007).*
(Continued)

*Primary Examiner* — Erin F Bergner
(74) *Attorney, Agent, or Firm* — STAAS & HALSEY LLP

(57) ABSTRACT

A cleaner including a wet cloth brush to which a pad is installable so as to be below a bottom surface of the wet cloth brush, the wet cloth brush including a pad motor configured to rotate a pad installed to the wet cloth brush, a water supplier configured to spray water to a surface to be cleaned, a light source configured to irradiate light to the pad installed to the wet cloth brush, and a processor configured to, based on an intensity of the light reflected from the pad, control a rotation speed of the pad motor, and/or control an amount of water sprayed by the water supplier to the surface to be cleaned.

12 Claims, 12 Drawing Sheets

(52) U.S. Cl.
CPC ..... *A47L 11/4038* (2013.01); *A47L 11/4069* (2013.01); *A47L 11/4088* (2013.01)

(58) Field of Classification Search
CPC . A47L 11/4088; A47L 11/4008; G01J 1/0219; G16Y 40/10
See application file for complete search history.

(56) References Cited

U.S. PATENT DOCUMENTS

| | | | | |
|---|---|---|---|---|
| 2018/0373242 | A1* | 12/2018 | Han | A47L 11/4011 |
| 2020/0397202 | A1 | 12/2020 | Artes et al. | |
| 2021/0030241 | A1* | 2/2021 | Kim | A47L 11/4088 |
| 2021/0156993 | A1* | 5/2021 | Gordon | A47L 11/4011 |
| 2022/0287532 | A1 | 9/2022 | Jang et al. | |

FOREIGN PATENT DOCUMENTS

| | | | | |
|---|---|---|---|---|
| KR | 10-1995-0002047 | | 3/1995 | |
| KR | 10-1995-0002048 | | 3/1995 | |
| KR | 10-1996-0014584 | | 10/1996 | |
| KR | 200435130 | Y1 * | 1/2007 | A47L 1/282 |
| KR | 10-2017-0028765 | | 3/2017 | |
| KR | 10-1759275 | | 7/2017 | |
| KR | 20-0489070 | | 8/2019 | |
| KR | 10-2023-0148716 | | 10/2023 | |
| WO | WO-2024020882 | A1 * | 2/2024 | A47L 11/28 |

OTHER PUBLICATIONS

Machine translation of WO-2024020882-A1 (Year: 2024).*
International Search Report dated Nov. 20, 2023 for International Application No. PCT/KR2023/010675.
Written Opinion of the International Searching Authority dated Nov. 20, 2023 for International Application No. PCT/KR2023/010675.

* cited by examiner

CLEANER AND METHOD FOR CONTROLLING THE SAME

CROSS-REFERENCE TO RELATED APPLICATION

This application is a continuation application, under 35 U.S.C. § 111 (a), of international application No. PCT/KR2023/010675, filed on Jul. 24, 2023, which claims priority under 35 U.S.C. § 119 to Korean Patent Application No. 10-2022-0135225, filed on Oct. 19, 2022, in the Korean Intellectual Property Office, the disclosures of which are incorporated by reference herein in their entireties.

BACKGROUND

1. Field

The disclosure relates to a cleaner including a wet cloth pad.

2. Description of Related Art

Stick type cleaners equipped with a wet cloth pad have recently been developed, and the stick cleaner with the wet cloth pad mounted thereon performs wet cleaning on the surface to be cleaned by rotating the wet cloth pad.

It is, however, a hassle for the user to check contamination of the wet cloth pad of the cleaner in person, and it is also inconvenient for the user to determine how to deal with various contamination sources.

SUMMARY

Aspects of embodiments of the disclosure will be set forth in part in the description which follows and, in part, will be apparent from the description, or may be learned by practice of the presented embodiments.

According to an embodiment of the disclosure, a cleaner includes a wet cloth brush to which a pad is installable so as to be below a bottom surface of the wet cloth brush, the wet cloth brush including a pad motor configured to rotate a pad installed to the wet cloth brush, a water supplier configured to spray water to a surface to be cleaned, and a light source configured to irradiate light to the pad installed to the wet cloth brush, and at least one processor configured to, based on an intensity of the light reflected from the pad, control a rotation speed of the pad motor, and/or control an amount of water sprayed by the water supplier to the surface to be cleaned.

According to an embodiment of the disclosure, the at least one processor may be configured to compare the intensity of the light reflected from the pad with a reference intensity of light reflection corresponding to a threshold of degradation of cleaning power to control the amount of the water sprayed by the water supplier.

According to an embodiment of the disclosure, the light source may be configured to transmit infrared light, and the at least one processor may be configured to control the amount of the water sprayed by the water supplier based on the intensity of the light reflected from the pad being greater than the reference intensity of light reflection corresponding to the threshold of degradation of cleaning power.

According to an embodiment of the disclosure, the light source may be configured to transmit visible light, and the at least one processor may be configured to control the amount of the water sprayed by the water supplier based on the intensity of the light reflected from the pad being smaller than the reference intensity of light reflection corresponding to the threshold of degradation of cleaning power.

According to an embodiment of the disclosure, the at least one processor may be configured to change an amount of controlling the reference intensity of light reflection according to user settings.

According to an embodiment of the disclosure, the at least one processor may be configured to control the pad motor to increase the rotation speed in proportion to a change rate of the intensity of the light reflected from the pad during cleaning.

According to an embodiment of the disclosure, the at least one processor may be configured to control the pad motor to increase the rotation speed in proportion to an accumulated integral value of amounts of changes in the intensity of the light reflected from the pad during cleaning.

According to an embodiment of the disclosure, the at least one processor may be configured to control the water supplier to spray water to the surface to be cleaned in response to the intensity of the light reflected from the pad being changed at a preset change rate in a direction representing that the pad is dry.

According to an embodiment of the disclosure, the at least one processor may be configured to guide a user to wash or replace the pad in response to the intensity of the light reflected from the pad being changed at a preset change rate in a direction representing that the pad is moist.

According to an embodiment of the disclosure, provided is a method of controlling a cleaner including a wet cloth brush to which a pad is installable so as to be below a bottom surface of the wet cloth brush, the method including controlling a light source to irradiate light to a pad installed to the wet cloth brush; and, based on an intensity of the light reflected from the pad, controlling a rotation speed of a pad motor to rotate the pad, and/or controlling an amount of water sprayed by a water supplier to a surface to be cleaned.

According to an embodiment of the disclosure, the controlling of the amount of the water sprayed by the water supplier may include comparing the intensity of the light reflected from the pad with a reference intensity of light reflection corresponding to a threshold of degradation of cleaning power.

According to an embodiment of the disclosure, the light source may be configured to transmit infrared light, and the controlling of the amount of the water sprayed by the water supplier may be based on the intensity of the light reflected from the pad being greater than the reference intensity of light reflection corresponding to the threshold of degradation of cleaning power.

According to an embodiment of the disclosure, the light source may be configured to transmit visible light, and the controlling of the amount of the water sprayed by the water supplier may be based on the intensity of the light reflected from the pad being or smaller than the reference intensity of light reflection corresponding to the threshold of degradation of cleaning power.

According to an embodiment of the disclosure, the method may further include changing an amount of controlling the reference intensity of light reflection according to user settings.

According to an embodiment of the disclosure, the controlling of the rotation speed of the pad motor may include controlling the pad motor to increase the rotation speed in proportion to a change rate of the intensity of the light reflected from the pad during cleaning.

BRIEF DESCRIPTION OF THE DRAWINGS

These and/or other embodiments of the disclosure will become apparent and more readily appreciated from the following description of embodiments, taken in conjunction with the accompanying drawings of which.

DETAILED DESCRIPTION

Figure 1:
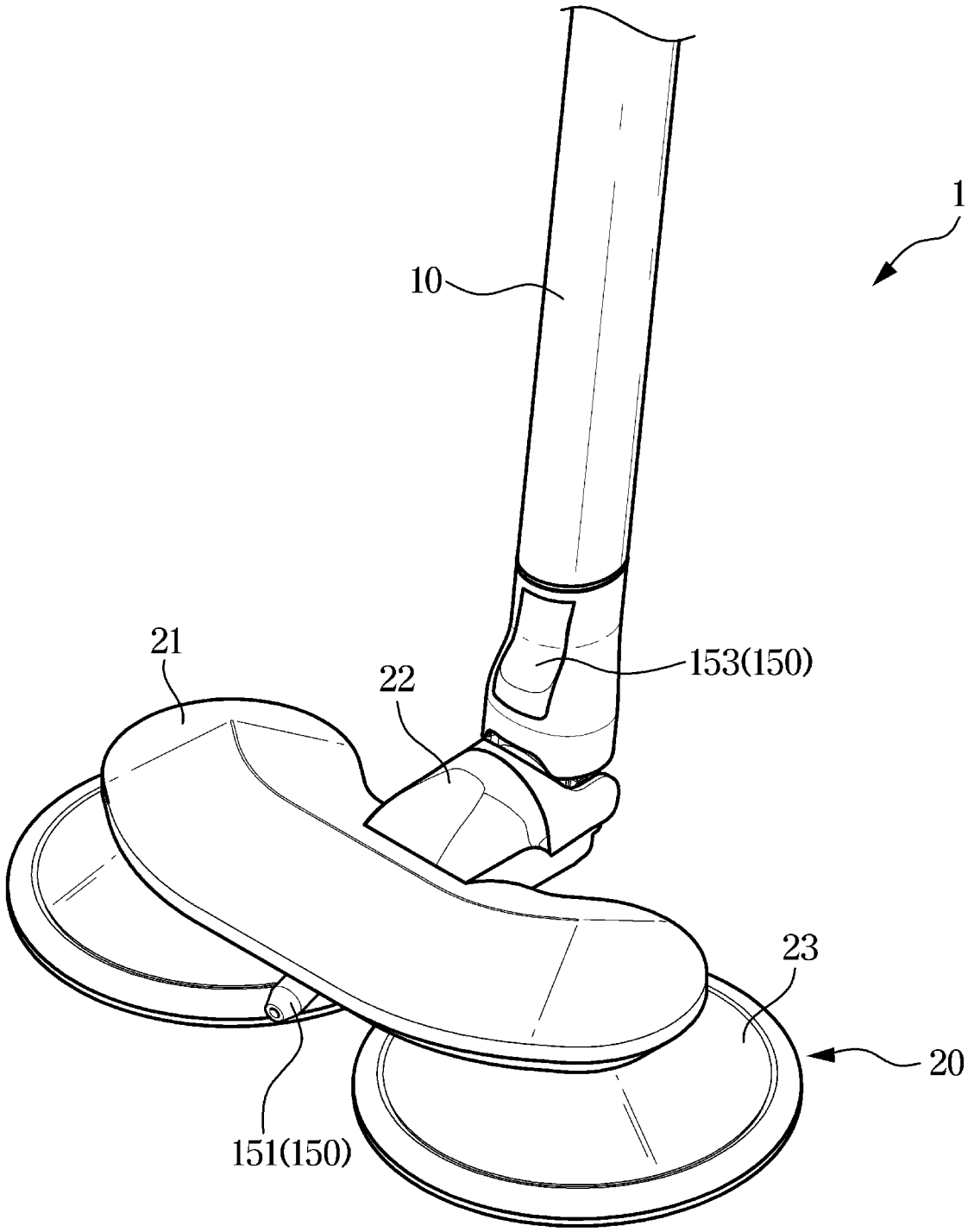
FIG. 1 is an exterior view of a cleaner, according to an embodiment of the disclosure.

Embodiments and features as described and illustrated in the disclosure are merely examples, and there may be various modifications replacing the embodiments and drawings at the time of filing this application.

It will be further understood that the term "connect" or its derivatives refer both to direct and indirect connection, and the indirect connection includes a connection over a wireless communication network.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure.

Furthermore, the terms, such as "~part", "~block", "~member", "~module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method steps are just used to identify the respective steps, but not to limit an order of the steps. Thus, unless the context clearly dictates otherwise, the written order may also be practiced otherwise.

Embodiments of the disclosure may provide a cleaner and method for controlling the same, by which cleaning intensity is controlled, water is supplied to the surface to be cleaned, or washing or replacement of the pad is guided for the user based on an intensity of light reflection after irradiation of light to the wet cloth pad.

According to an embodiment, a cleaner and method for controlling the same may increase wet cleaning efficiency by controlling cleaning intensity, supplying water to a surface to be cleaned, or guiding the user to wash or replace a wet cloth pad based on an intensity of light reflection after irradiation of light to the wet cloth pad.

Reference will now be made in detail to embodiments of the disclosure, which are illustrated in the accompanying drawings.

Figure 2:
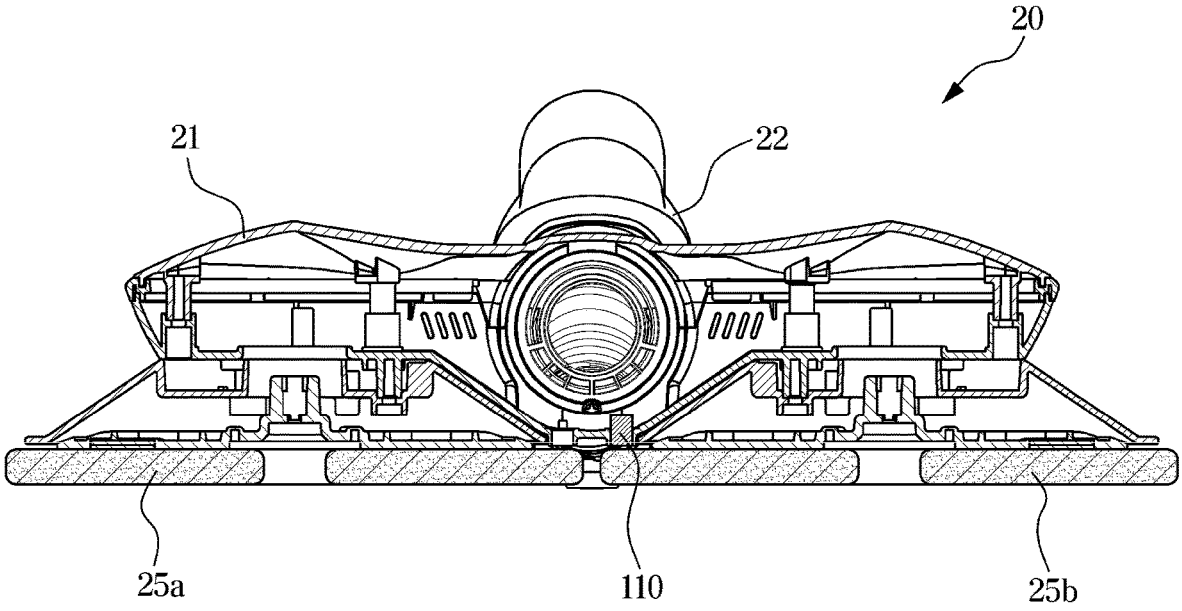
FIG. 2 is a cross-sectional view of a wet cloth brush of a cleaner, according to an embodiment of the disclosure.

FIG. 1 is an exterior view of a cleaner, according to an embodiment, and FIG. 2 is a cross-sectional view of a wet cloth brush of a cleaner, according to an embodiment.

Referring to FIGS. 1 and 2, a cleaner 1 includes a main body 10 and a wet cloth brush 20 connected to the main body 10 and including at least one pad 25 (25*a* and 25*b*) rotationally arranged on the bottom surface. At least one pad 25 may comprises a material that can absorb water (e.g. cloth, sponge, etc). Thus, hereinafter the pad 25 is defined as the wet cloth pad 25 for intuitiveness of meaning, however, it should be understood that the wet cloth pad 25 may be made of other materials other than the cloth.

Furthermore, the cleaner 1 includes a handle (not shown) provided on an upper portion of the main body 10 for the user to hold to drive the wet cloth brush 20.

In an embodiment, the wet cloth brush 20 includes a brush body 21, a connector 22 that connects between the main body 10 and the brush body 21, and a wet cloth mounting part 23 for supporting the wet cloth pad 25 rotationally installed underneath the brush body 21.

The wet cloth brush 20 may also include a water supplier 150 capable of spraying water to a surface to be cleaned, and the water supplier 150 may include a water spray nozzle 151, a water tank 153 that stores water to be supplied to the water spray nozzle 151, and a tube (not shown) for water supply between the water spray nozzle 151 and the water tank 153.

The wet cloth brush 20 includes a pad motor (not shown) inside for rotating the wet cloth pad 25, and a pair of wet cloth mounting parts 23 are rotationally installed on the bottom of the brush body 21. The wet cloth pad 25 may be detachably installed underneath the wet cloth mounting part 23. The wet cloth mounting part 23 may include a rotating plate (not shown) rotationally connected by the pad motor of the wet cloth brush 20. The wet cloth pad 25 may be detachably installed on the rotating plate.

The connector 22 may be rotationally coupled with the brush body 21. In other words, the connector 22 may be angle-adjustably coupled with the brush body 21. The connector 22 may further include at least one connecting pipe.

Although not shown, the handle of the cleaner 1 may be connected to the wet cloth brush 20 through the connector 22. For example, a button may be arranged on the handle to drive the cleaner body 2.

The wet cloth pad 25 may be rotationally mounted on the brush body 21. The wet cloth mounting part 23 to which the wet cloth pad 25 is rotationally coupled may be arranged at the brush body 21. The wet cloth mounting part 23 may have the rotating plate formed in a circular shape. The wet cloth mounting part 23 may be arranged to connect between the brush body 21 and the wet cloth pad 25.

The wet cloth pad 25 is a floorcloth used in a moistened state, and may be formed in a circular form to be rotated.

The wet cloth pad 25 is arranged to wipe the floor while being rotated. The wet cloth pad 25 may be formed of an ordinary fabric material. The wet cloth pad 25 may be detachably coupled to the wet cloth mounting part 23 of the brush body 21. The wet cloth pad 25 formed of the ordinary fabric material may be detachably mounted on the wet cloth mounting part 23 by VELCRO®.

The wet cloth pad 25 may be formed in a circular shape. The wet cloth pad 25 may have villi formed on both surfaces to be used on both sides. In order for the wet cloth pad 25 to be detachably coupled to the wet cloth mounting part 23, VELCRO® fastening(not shown) may be formed to be attached to or detached from floorcloth villi may be arranged on the rotating plate.

In this case, an amount of water content of the wet cloth pad 25 may be reduced while the cleaner 1 performs cleaning, and the reduction range may differ by degrees of contamination of the surface in an area to be cleaned.

In other words, the higher the degree of contamination of the wet cloth pad 25 as the cleaning is continued, the less the amount of water content of the wet cloth pad 25, so the wet cloth pad 25 needs to be replaced or washed.

As such, the amount of water content of the wet cloth pad 25 may represent a degree of contamination of the wet cloth pad 25, and an amount of changes thereof may represent a degree of contamination of the surface to be cleaned. Based on this, the cleaner 1 in the disclosure aims to increase wet cleaning efficiency of the cleaner 1 by identifying and using an amount of water content of the wet cloth pad 25 for control.

Specifically, the cleaner 1 may include a light sensor module 110 for irradiating light to the wet cloth pad 25 and detecting an intensity of light reflected from the wet cloth pad 25, as shown in FIG. 2.

The light sensor module 110 may be arranged on a top surface of the wet cloth pad 25 to irradiate light and measure an intensity of light reflected from the wet cloth pad 25. For this, the light sensor module 110 may include a light source for irradiating light and a light sensor for receiving reflected light. Where to install the light sensor module 110 is not, however, limited to the top surface, but may be any position at which light is irradiated to the wet cloth pad 25 and the reflected light may be received.

An exterior of the cleaner 1 and components exposed on the exterior have thus far been described. The cleaner 1 controlling cleaning intensity of the cleaner 1, spraying water to the surface to be cleaned, or guiding the user to replace or wash the wet cloth pad 25 based on an intensity of light reflected from the wet cloth pad 25 will now be described in detail.

Figure 3:
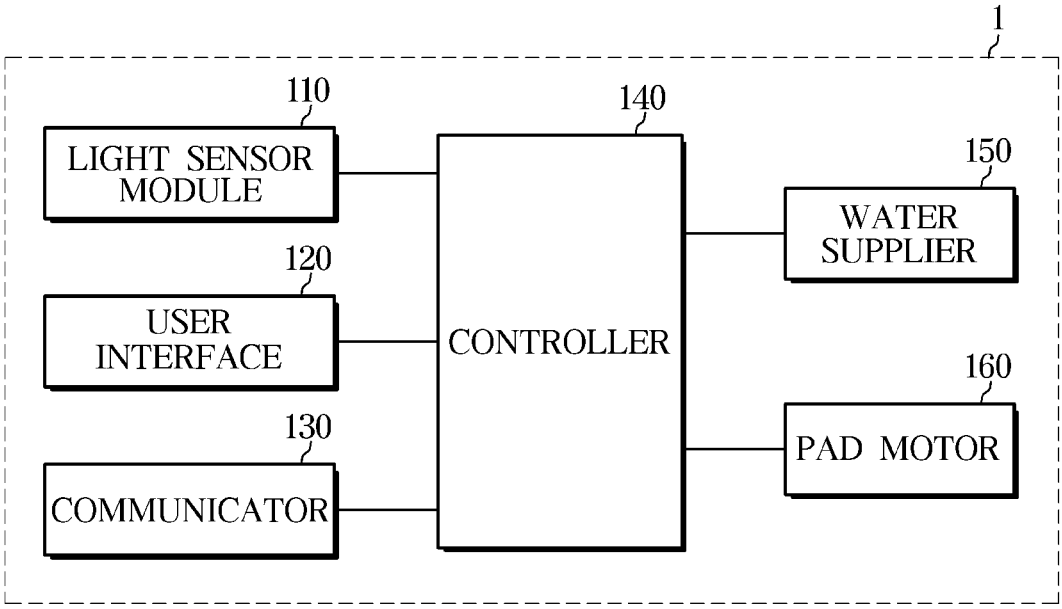
FIG. 3 is a control block diagram of a cleaner, according to an embodiment of the disclosure.
Figure 4:
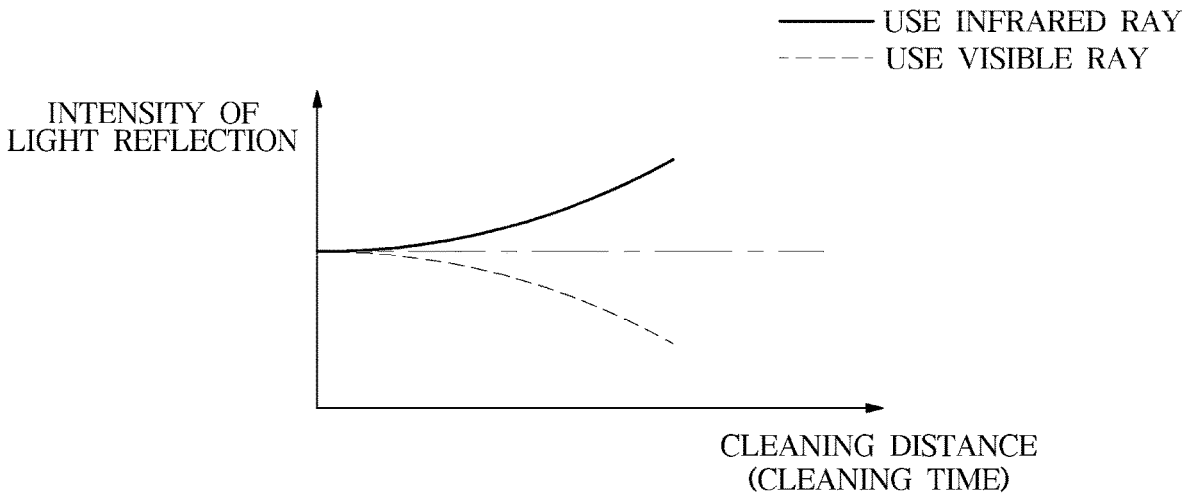
FIG. 4 is a diagram for describing changes in output depending on light sensor module types, according to an embodiment of the disclosure.

FIG. 3 is a control block diagram of the cleaner 1, according to an embodiment, and FIG. 4 is a diagram for describing changes in output depending on types of the light sensor module 110, according to an embodiment.

Referring to FIG. 3, the cleaner 1 according to an embodiment includes the light sensor module 110 for irradiating light to the wet cloth pad 25 and detecting reflected light, a user interface 120 for receiving an input from the user or displaying information, a communicator 130 for communicating with a user terminal, a controller 140 for controlling cleaning intensity, spraying water to a surface to be cleaned, or guiding the user to replace or wash the wet cloth pad 25, the water supplier 150 for spraying water to the surface to be cleaned, and a pad motor 160 for rotating the wet cloth pad 25.

The components of the cleaner 1 as shown in FIG. 3 are merely an example, and in some embodiments, some of the components shown in FIG. 3 may be omitted or additional components not shown may be added thereto.

In an embodiment, the light sensor module 110 may include a light source arranged on a side to the wet cloth pad 25 for irradiating light to the wet cloth pad 25, and a light sensor for receiving light reflected from the wet cloth pad 25.

Furthermore, the light sensor module 110 may include a signal processing circuit for converting an intensity of the received light to an electric signal, an analog to digital (A/D) converter for digitizing the electric signal, a memory for storing the digitized electric signal, and a digital signal processor for interpreting, analyzing and processing the stored signal.

With this, the light sensor module 110 may determine an intensity of reflection of light from the wet cloth pad 25 and send the determined intensity of reflection of light to the controller 140.

In this case, the light sensor module 110 may use an infrared light source or a visible light source depending on the embodiment.

Infrared rays (e.g., having wavelengths of 900 nm) are absorbed by a liquid, so the more the amount of water content in the wet cloth pad 25, the smaller the intensity of infrared light reflected after the infrared light is irradiated to the wet cloth pad 25.

Hence, as shown in FIG. 4, when the light sensor module 110 uses infrared rays, the longer the distance or time of cleaning, the smaller the amount of water content in the wet cloth pad 25, so the intensity of reflection of light from the wet cloth pad 25 increases.

On the other hand, visible rays are reflected by a liquid, so the more the amount of water content in the wet cloth pad 25, the more the intensity of visible light reflected after the visible light is irradiated to the wet cloth pad 25.

Hence, as shown in FIG. 4, when the light sensor module 110 uses visible rays, the longer the distance or time of cleaning, the smaller the amount of water content in the wet cloth pad 25, and thus the intensity of reflection of light from the wet cloth pad 25 decreases.

In an embodiment, the user interface 120 may be arranged on the handle of the main body 10 to receive a user input or display information. For this, the user interface 120 may be provided as a known-type of input device or a known-type of display panel, or may have a structure in which a touch panel and a display panel are integrally formed.

For example, the user interface 120 may receive a user input to adjust control intensity when there is a sudden change in intensity of reflection of light from the wet cloth pad 25, and display a guidance message for replacement or washing of the wet cloth pad 25 based on the contamination degree of the wet cloth pad 25.

In an embodiment, the communicator 130 may perform wireless communication with a terminal device of the user of the cleaner 1. For this, the communicator 130 may be provided as a known-type of radio communication module.

For example, the communicator 130 may receive a user input from the user terminal to adjust control intensity when there is a sudden change in intensity of reflection of light from the wet cloth pad 25, and transmit, to the user terminal, the guidance message for replacement or washing of the wet cloth pad 25 depending on the contamination degree of the wet cloth pad 25.

In an embodiment, the controller 140 may control rotation speed of the pad motor 160 based on the intensity of reflection of light from the wet cloth pad 25.

Specifically, the controller 140 may control the pad motor 160 to increase rotation speed of the wet cloth pad 25 in proportion to a change rate of the intensity of reflection of light from the wet cloth pad 25 during cleaning.

Furthermore, the controller 140 may control the pad motor 160 to increase rotation speed of the wet cloth pad 25 in proportion to an accumulated integral value of amounts of changes in the intensity of reflection of light from the wet cloth pad 25 during cleaning.

In an embodiment, the controller 140 may control water supply of the water supplier 150 based on the intensity of reflection of light from the wet cloth pad 25.

Specifically, the controller 140 may compare the intensity of reflection of light from the wet cloth pad 25 with a reference intensity of light reflection corresponding to a threshold of degradation of cleaning power to control water supply of the water supplier 150.

For example, when the light sensor module 110 transmits or receives infrared light, the controller 140 may control the water supplier 150 to spray water to the surface to be cleaned when the intensity of reflection of light from the wet cloth pad 25 is equal to or greater than a first reference intensity of reflection of light corresponding to a threshold of degradation of cleaning power.

Furthermore, when the light sensor module 110 transmits or receives visible light, the controller 140 may control the water supplier 150 to spray water to the surface to be cleaned when the intensity of reflection of light from the wet cloth pad 25 is equal to or smaller than a second reference intensity of reflection of light corresponding to a threshold of degradation of cleaning power.

Furthermore, the controller 140 may change a degree of controlling the reference intensity of reflection of light based on user settings.

In an embodiment, the controller 140 may control the water supplier 150 to spray water to the surface to be cleaned when the intensity of reflection of light from the wet cloth pad 25 is changed at a preset change rate or more in a direction representing that the wet cloth pad 25 is dry.

Furthermore, in an embodiment, the controller 140 may control to guide the user to wash or replace the wet cloth pad 25 when the intensity of reflection of light from the wet cloth pad 25 is changed at a preset change rate or more in a direction representing that the wet cloth pad 25 is moist.

The controller 140 may include at least one memory for storing a program for carrying out the aforementioned and following operations, and at least one processor for executing the program. In a case that the memory and the processor are each provided in the plural, they may be integrated in a single chip or physically distributed.

In an embodiment, the water supplier 150 includes the water spray nozzle 151 for spraying water to the surface to be cleaned and the water tank 153 for supplying water to the water spray nozzle 151. Furthermore, the water supplier 150 includes a pump (not shown) that pressurizes water to spray water from the water spray nozzle 151.

In an embodiment, the pad motor 160 may rotate the wet cloth pad 25, and change the rotation speed under the control of the controller 140 to change the rotation speed of the wet cloth pad 25.

The control block diagram of the cleaner 1 has thus far been described. How the cleaner 1 performs control based on the intensity of reflection of light from the wet cloth pad 25 will now be described based on the control block diagram.

Figure 5:
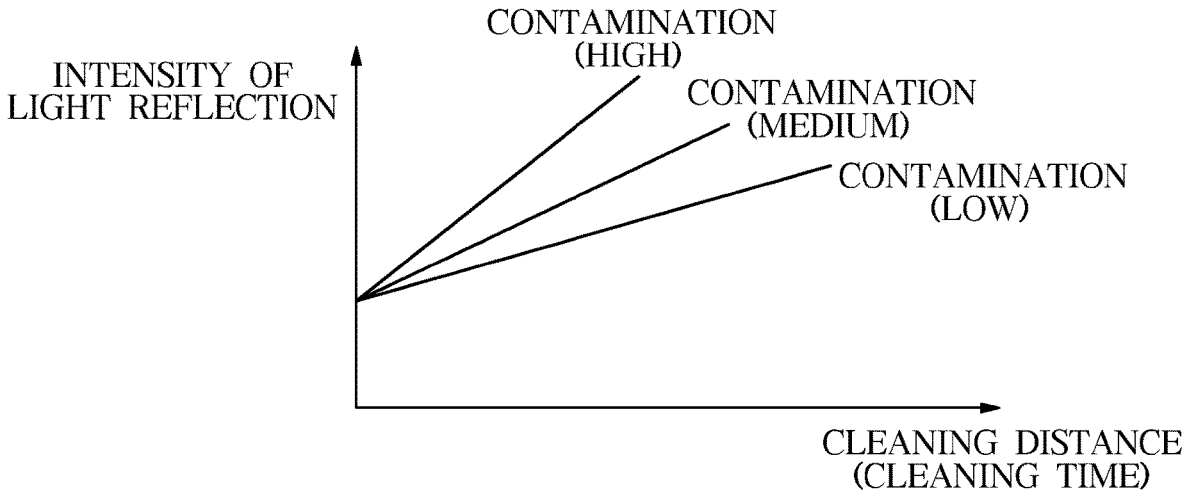
FIG. 5 is a diagram for describing an occasion when a cleaner controls cleaning intensity based on an intensity of reflection of light, according to an embodiment of the disclosure.
Figure 6:
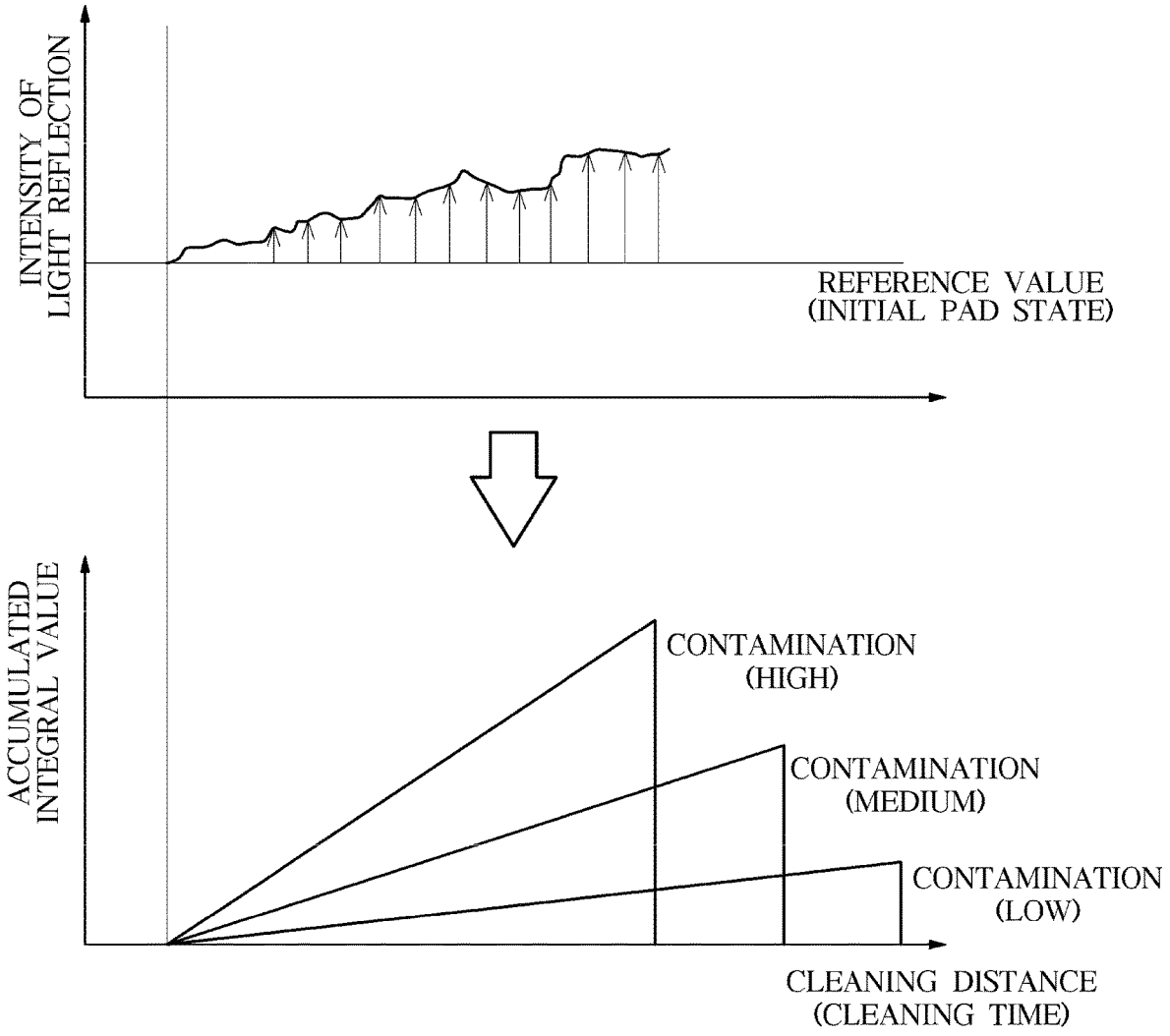
FIG. 6 is a diagram for describing an occasion when a cleaner controls cleaning intensity based on an accumulated integral value of amounts of changes in intensity of reflection of light, according to an embodiment of the disclosure.

FIG. 5 is a diagram for describing an occasion when the cleaner 1 controls cleaning intensity based on an intensity of reflection of light, according to an embodiment, and FIG. 6 is a diagram for describing an occasion when the cleaner 1 controls cleaning intensity based on an accumulated integral value of amounts of changes in intensity of reflection of light, according to an embodiment.

Referring to FIG. 5, in an embodiment, the cleaner 1 may control the pad motor 160 to increase rotation speed of the wet cloth pad 25 in proportion to a change rate of the intensity of reflection of light from the wet cloth pad 25 with an increase in cleaning distance or cleaning time.

For example, when the cleaner 1 performs cleaning, the contamination degree of the wet cloth pad 25 may increase and the amount of water content of the wet cloth pad 25 may decrease, and when the light sensor module 110 uses infrared rays, the intensity of reflection of light from the wet cloth pad 25 may increase.

In this case, as shown in FIG. 5, the higher the contamination degree of the surface to be cleaned, the larger the amount of changes in amount of water content of the wet cloth pad 25, so the change rate (a change slope) of the intensity of reflection of light from the wet cloth pad 25 may increase.

The cleaner 1 adaptively controls cleaning intensity depending on the contamination degree of the surface to be cleaned by increasing cleaning intensity on the surface as the rotation speed of the wet cloth pad 25 increases the higher the change rate of the intensity of reflection of light from the wet cloth pad 25.

For example, the cleaner 1 may divide the cleaning intensity into three levels (e.g., strong, normal, speedy) to adaptively change the cleaning intensity depending on the change rate (change slope) of the intensity of reflection of light from the wet cloth pad 25.

Furthermore, in an embodiment, the cleaner 1 may control the pad motor 160 to increase rotation speed of the wet cloth pad 25 in proportion to an accumulated integral value of amounts of changes in the intensity of reflection of light from the wet cloth pad 25 with an increase in cleaning distance or cleaning time, as shown in FIG. 6. In other words, the controller 140 may use the accumulated integral value of changes in intensity of reflection of light as a control factor in consideration of a measurement error in the intensity of reflection of light from the wet cloth pad 25.

Although FIGS. 5 and 6 illustrate a case that the light sensor module 110 uses infrared rays, embodiments of the disclosure are not limited thereto, but descriptions of FIGS. 5 and 6 may also be applied to a case that the light sensor module 110 uses visible rays with the exception of the direction of a change in intensity of reflection of light during motion.

Figure 7:
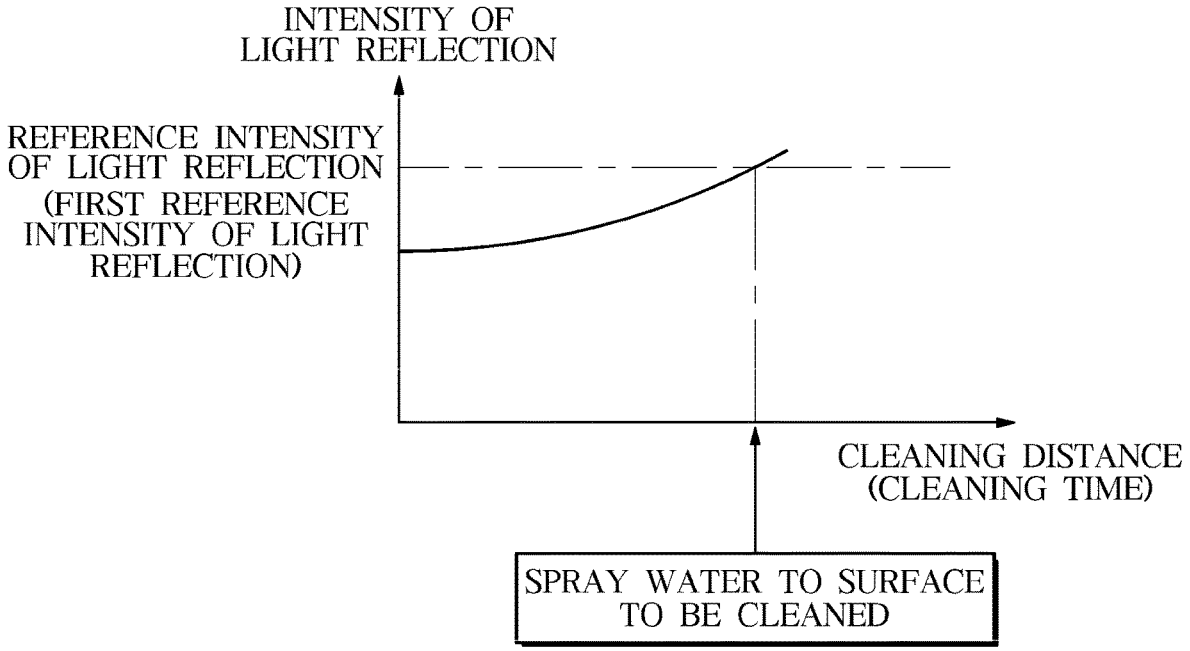
FIG. 7 is a diagram for describing an occasion when a cleaner uses a light sensor module that uses infrared rays to determine water spray to a surface to be cleaned, according to an embodiment of the disclosure.
Figure 8:
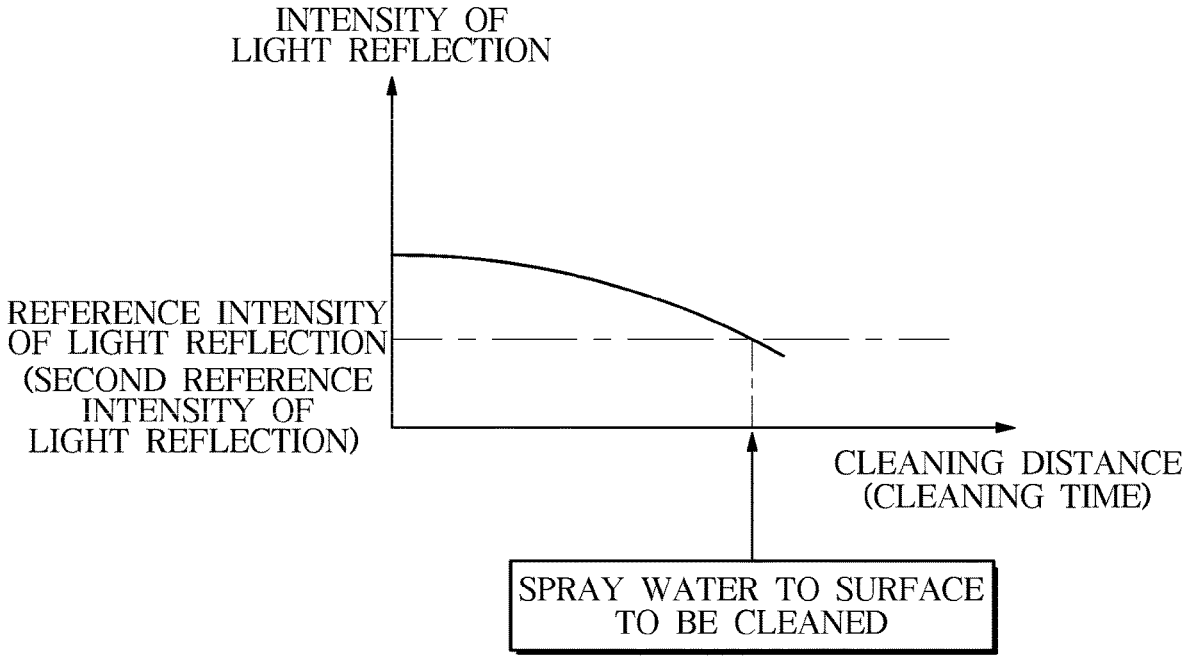
FIG. 8 is a diagram for describing an occasion when a cleaner uses a light sensor module that uses visible rays to determine water spray onto a surface to be cleaned, according to an embodiment of the disclosure.

FIG. 7 is a diagram for describing an occasion when the cleaner 1 uses the light sensor module 110 that uses infrared rays to determine water spray to a surface to be cleaned, according to an embodiment, and FIG. 8 is a diagram for describing an occasion when the cleaner 1 uses a light sensor module that uses visible rays to determine water spray to a surface to be cleaned, according to an embodiment.

In an embodiment, the cleaner 1 may control water supply of the water supplier 150 based on the intensity of reflection of light from the wet cloth pad 25.

Specifically, the cleaner 1 may compare the intensity of reflection of light from the wet cloth pad 25 with a reference intensity of light reflection corresponding to a threshold of degradation of cleaning power to control water supply of the water supplier 150.

For example, as shown in FIG. 7, when the light sensor module 110 transmits or receives infrared light, the controller 140 may control the water supplier 150 to spray water to the surface to be cleaned when the intensity of reflection of light from the wet cloth pad 25 is equal to or greater than a first reference intensity of reflection of light corresponding to a threshold of degradation of cleaning power.

Furthermore, as shown in FIG. 8, when the light sensor module 110 transmits or receives visible light, the controller 140 may control the water supplier 150 to spray water to the surface to be cleaned when the intensity of reflection of light from the wet cloth pad 25 is equal to or smaller than a second reference intensity of reflection of light corresponding to a threshold of degradation of cleaning power.

In this case, in an embodiment, the cleaner 1 may determine whether to spray water to the surface to be cleaned by comparing an accumulated integral value of amounts of changes in intensity of reflection of light from the wet cloth pad 25 during cleaning with a reference accumulated integral value corresponding to a threshold of degradation of cleaning power. In other words, the cleaner 1 may use the accumulated integral value of changes in intensity of reflection of light as a control factor in consideration of a measurement error in the intensity of reflection of light from the wet cloth pad 25.

Furthermore, the cleaner 1 may change a degree of controlling the reference intensity of reflection of light based on user settings. In other words, the user may control sensitivity of the control through the user interface 120 or the user terminal when the intensity of reflection of light from the wet cloth pad 25 changes abruptly.

Figure 9:
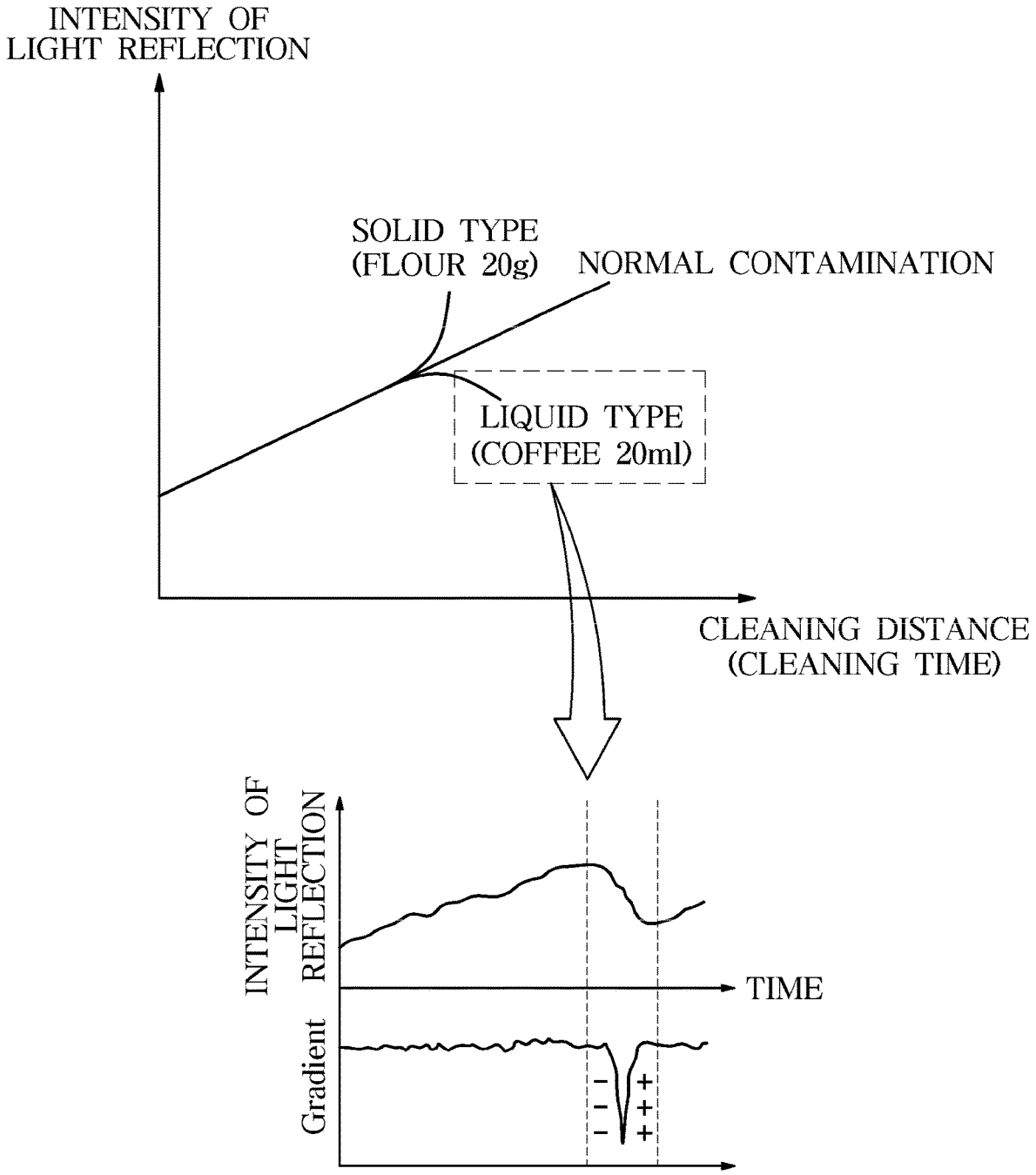
FIG. 9 is a diagram for illustrating an occasion when a cleaner identifies contamination patterns based on an intensity of reflection of light, according to an embodiment of the disclosure.

FIG. 9 is a diagram for illustrating an occasion when the cleaner 1 identifies contamination patterns based on an intensity of reflection of light, according to an embodiment.

Referring to FIG. 9, the cleaner 1 in an embodiment may determine whether the intensity of reflection of light from the wet cloth pad 25 changes at a preset change rate or more based on the intensity of reflection of light reflecting from the wet cloth pad 25.

When the cleaner 1 absorbs a lot of liquid contaminants (e.g., absorbs 20 ml of coffee) while performing cleaning, the intensity of reflection of light from the wet cloth pad 25 may decrease dramatically (in a case that the light sensor module 110 uses infrared rays).

Furthermore, when the cleaner 1 absorbs a lot of solid contaminants (e.g., absorbs 20 g of flour) while performing cleaning, the intensity of reflection of light from the wet cloth pad 25 may increase dramatically (in a case that the light sensor module 110 uses infrared rays).

As such, when a lot of liquid contaminants are absorbed or a lot of solid contaminants are absorbed, the contamination degree of the wet cloth pad 25 increases significantly, so the cleaning with the wet cloth pad 25 may be inefficient.

Hence, in an embodiment, the cleaner 1 may control the water supplier 150 to spray water to the surface to be cleaned when the intensity of reflection of light from the wet cloth pad 25 is changed at a preset change rate or more in a direction representing that the wet cloth pad 25 is dry.

Furthermore, in an embodiment, the cleaner 1 may control to guide the user to wash or replace the wet cloth pad 25 when the intensity of reflection of light from the wet cloth pad 25 is changed at a preset change rate or more in a direction representing that the wet cloth pad 25 is moist. For example, the cleaner 1 may control the user interface 120 to guide the user to wash or replace the wet cloth pad 25 or control the communicator 130 to transmit the guidance message to a user terminal 30.

An embodiment of a method of controlling the cleaner 1 will now be described from a perspective. For the method of controlling the cleaner 1, the cleaner 1 in the aforementioned embodiments may be used. Hence, what are described above with reference to FIGS. 1 to 10 may be equally applied in the method of controlling the cleaner 1.

Figure 10:
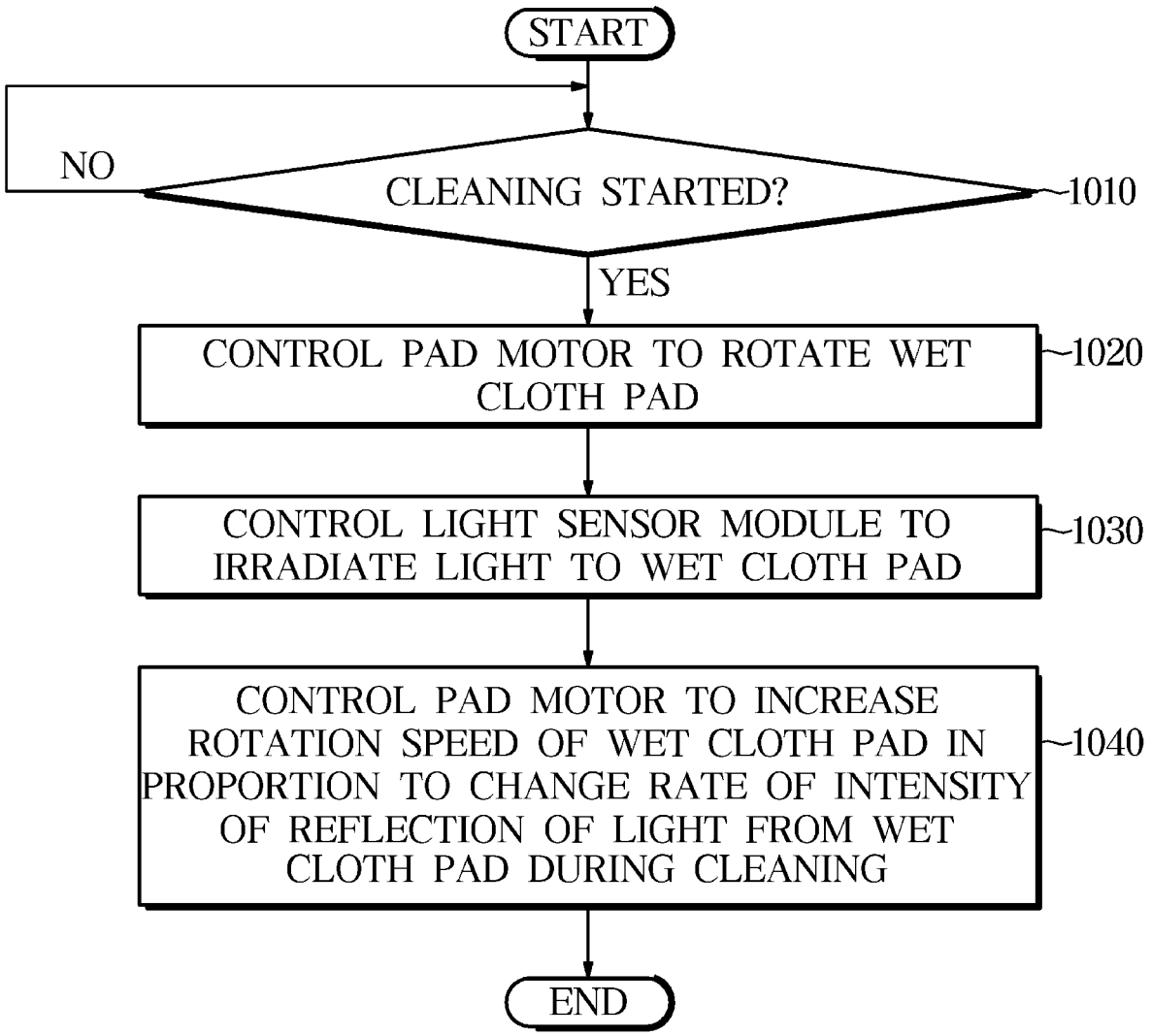
FIG. 10 is a flowchart of controlling rotation speed of a pad motor based on an intensity of reflection of light from a wet cloth pad in a method of controlling a cleaner, according to an embodiment of the disclosure.

FIG. 10 is a flowchart of controlling rotation speed of the pad motor 160 based on an intensity of reflection of light from the wet cloth pad 25 in a method of controlling the cleaner 1, according to an embodiment.

Referring to FIG. 10, in an embodiment, when the cleaner 1 starts cleaning in 1010, the cleaner 1 may control the pad motor 160 to rotate the wet cloth pad 25 in 1020 and control the light sensor module 110 to irradiate light to the wet cloth pad 25 in 1030.

In an embodiment, the cleaner 1 may control the pad motor 160 to increase rotation speed of the wet cloth pad 25 in proportion to a change rate of the intensity of reflection of light from the wet cloth pad 25 during cleaning, in 1040.

Specifically, the cleaner 1 adaptively controls cleaning intensity depending on the contamination degree of the floor by increasing cleaning intensity on the floor as the rotation speed of the wet cloth pad 25 increases the higher the change rate of the intensity of light reflection from the wet cloth pad 25.

For example, the cleaner 1 may divide the cleaning intensity into three levels (e.g., strong, normal, speedy) to adaptively change the cleaning intensity depending on the change rate (change slope) of the intensity of reflection of light from the wet cloth pad 25.

Figure 11:
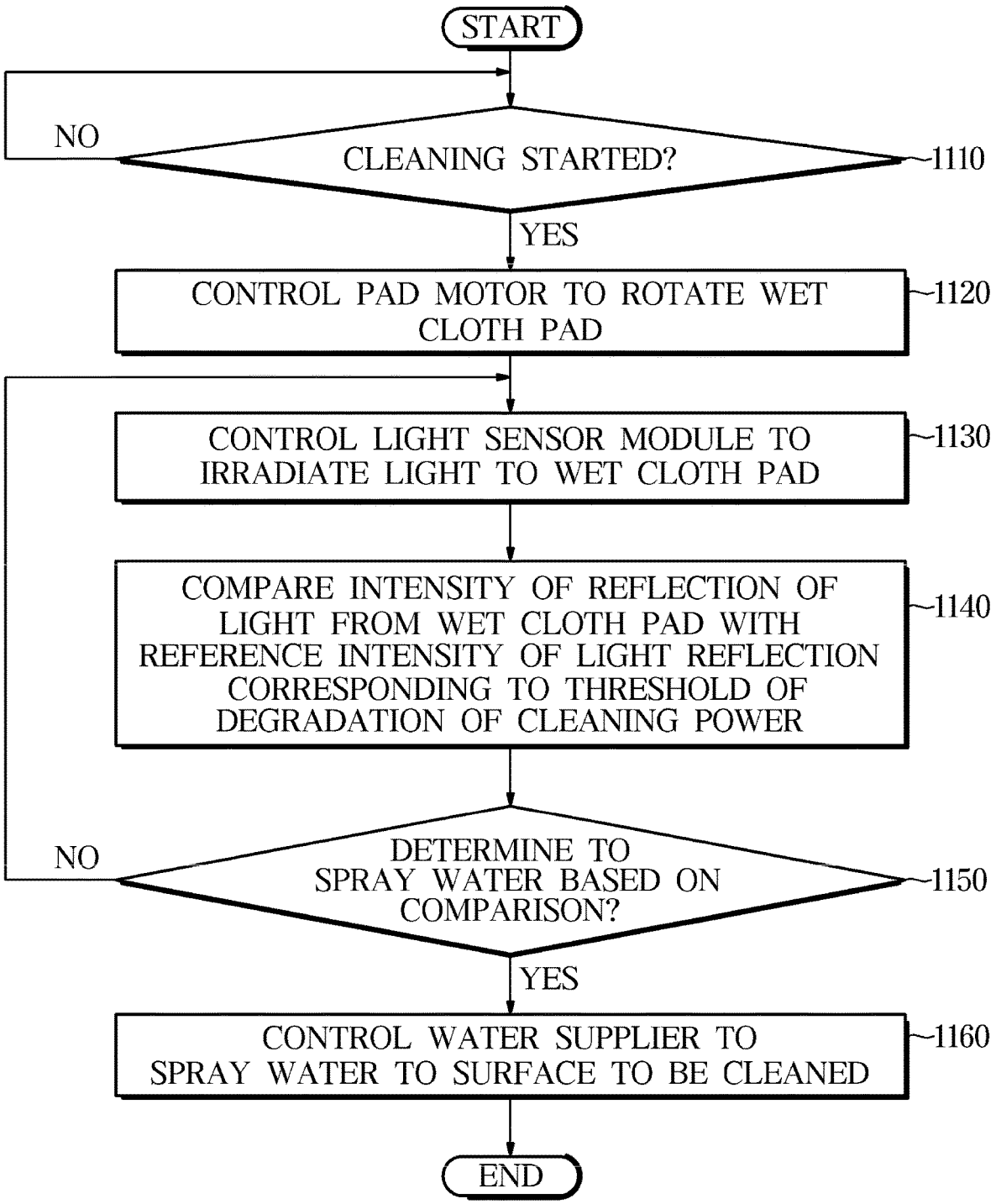
FIG. 11 is a flowchart of controlling water spray to a surface to be cleaned based on an intensity of reflection of light from a wet cloth pad in a method of controlling a cleaner, according to an embodiment of the disclosure.

FIG. 11 is a flowchart of controlling water spray to a surface to be cleaned based on an intensity of reflection of light from the wet cloth pad 25 in a method of controlling the cleaner 1, according to an embodiment.

Referring to FIG. 11, in an embodiment, when the cleaner 1 starts cleaning in 1110, the cleaner 10 may control the pad motor 160 to rotate the wet cloth pad 25 in 1120 and control the light sensor module 110 to irradiate light to the wet cloth pad 25 in 1130.

In an embodiment, the cleaner 1 may compare the intensity of reflection of light from the wet cloth pad 25 with a reference intensity of reflection of light corresponding to a threshold of degradation of cleaning power in 1140, and when determining to spray water based on the comparison result in 1150, the cleaner 10 may control the water supplier 150 to spray water to the surface to be cleaned in 1160.

For example, as shown in FIG. 7, when the light sensor module 110 transmits or receives infrared light, the cleaner 1 may control the water supplier 150 to spray water to the surface to be cleaned when the intensity of reflection of light from the wet cloth pad 25 is equal to or greater than a first reference intensity of reflection of light corresponding to a threshold of degradation of cleaning power.

Furthermore, as shown in FIG. 8, when the light sensor module 110 transmits or receives visible light, the cleaner 1 may control the water supplier 150 to spray water to the surface to be cleaned when the intensity of reflection of light from the wet cloth pad 25 is equal to or smaller than a second reference intensity of reflection of light corresponding to a threshold of degradation of cleaning power.

Figure 12:
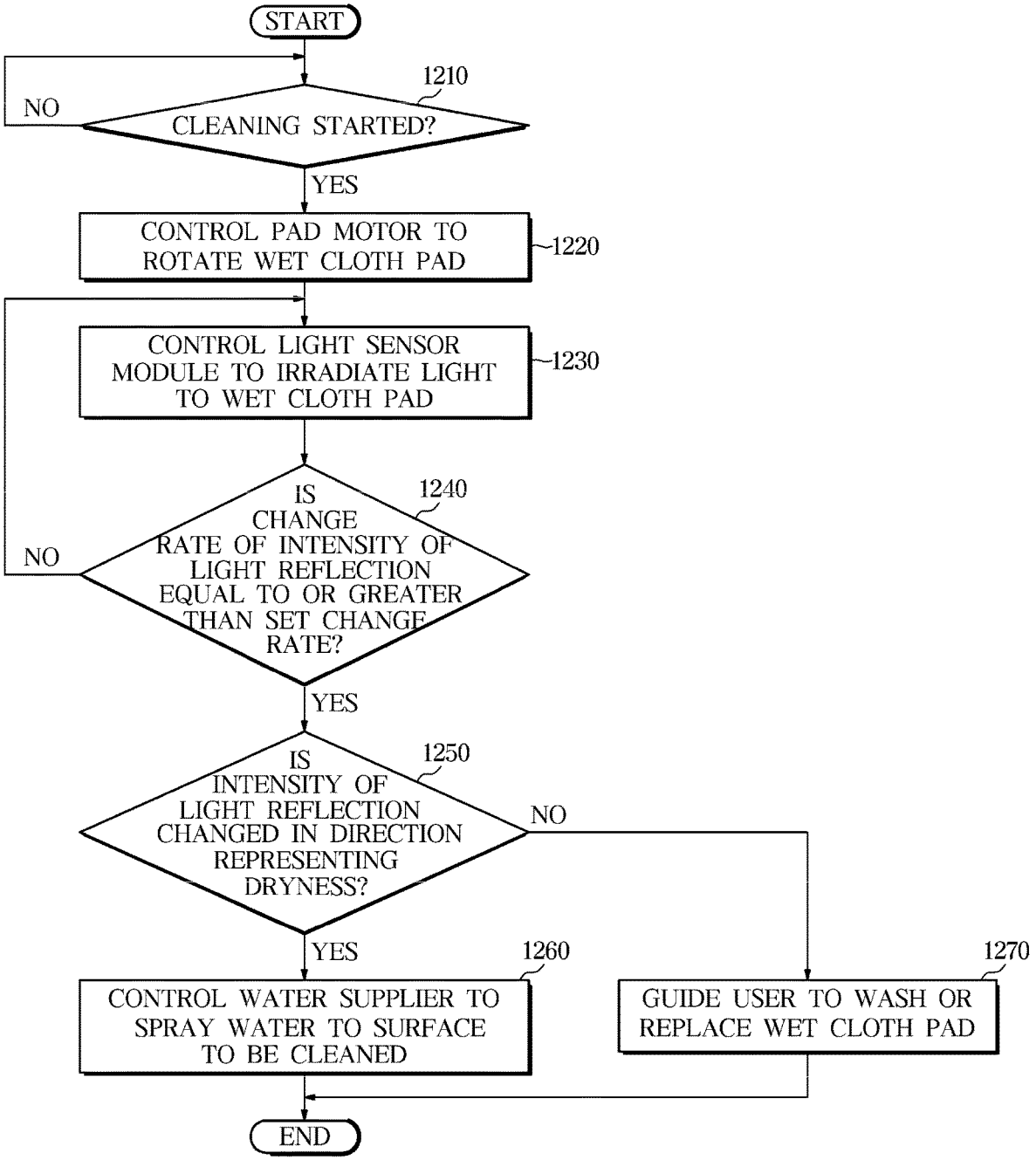
FIG. 12 is a flowchart of controlling a cleaner based on contamination patterns in a method of controlling the cleaner, according to an embodiment of the disclosure.

FIG. 12 is a flowchart of controlling the cleaner 1 based on contamination patterns in a method of controlling the cleaner 1, according to an embodiment.

Referring to FIG. 12, in an embodiment, when the cleaner 1 starts cleaning in 1210, the cleaner 10 may control the pad motor 160 to rotate the wet cloth pad 25 in 1220 and control the light sensor module 110 to irradiate light to the wet cloth pad 25 in 1230.

In an embodiment, when the change rate of the intensity of light reflection is equal to or greater than a set change rate in 1240 and the intensity of light reflection has changed in a direction representing dryness in 1250, the cleaner 1 may control the water supplier 150 to spray water to the surface to be cleaned in 1260.

Furthermore, in an embodiment, when the change rate of the intensity of light reflection is equal to or greater than the set change rate in 1240 and the intensity of light reflection has changed in a direction representing dryness in 1250, the cleaner 1 may guide the user to wash or replace the wet cloth pad 25 in 1270.

According to an example embodiment of the disclosure, the controlling of the rotation speed of the pad motor may include controlling the pad motor to increase rotation speed of the wet cloth pad in proportion to an accumulated integral value of amounts of changes in intensity of reflection of light from the wet cloth pad during cleaning.

According to an example embodiment of the disclosure, the method of controlling the cleaner may further include controlling the water supplier to spray water to the surface to be cleaned in response to an intensity of reflection of light from the wet cloth pad being changed at a preset change rate or more in a direction representing that the wet cloth pad is dry.

According to an example embodiment of the disclosure, the method of controlling the cleaner may further include controlling to guide the user to wash or replace the wet cloth pad in response to an intensity of reflection of light from the wet cloth pad being changed at a preset change rate or more in a direction representing that the wet cloth pad is moist.

Meanwhile, the embodiments of the disclosure may be implemented in the form of a recording medium for storing instructions to be carried out by a computer. The instructions may be stored in the form of program codes, and when executed by a processor, may generate program modules to perform operations in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The embodiments of the disclosure have thus far been described with reference to accompanying drawings. It will be obvious to those of ordinary skill in the art that the disclosure may be practiced in other forms than the embodiments of the disclosure as described above without changing the technical idea or essential features of the disclosure. The above embodiments of the disclosure are only by way of example, and should not be construed in a limited sense.

What is claimed is:

1. A cleaner comprising:

a wet cloth brush to which a pad is installable so as to be below a bottom surface of the wet cloth brush, the wet cloth brush including:

a pad motor configured to rotate a pad installed to the wet cloth brush, a water supplier configured to spray water to a surface to be cleaned, and a light source module configured to transmit light including at least one of infrared and visible light to the pad installed to the wet cloth brush, and configured to convert an amount of light reflected from the pad to a digitized electric signal; and at least one processor configured to, based on the digitized electric signal converted from the amount of the light reflected from the pad, control a rotation speed of the pad motor, and/or control an amount of water sprayed by the water supplier to the surface to be cleaned, and the at least one processor is configured to control the pad motor to increase the rotation speed as a digitized electric signal converted from the amount of the infrared light reflected from the pad during cleaning increases, and control the pad motor to increase the rotation speed as a digitized electric signal converted from the amount of the visible light reflected from the pad during cleaning decreases.

2. The cleaner of claim 1, wherein the at least one processor is configured to:

measure a rate of change in the digitized electric signal converted from the amount of light reflected from the pad, and control the water supplier to spray water to the surface to be cleaned in response to the rate of change in the digitized electric signal converted from the amount of the light reflected from the pad being changed at a preset change rate.

3. The cleaner of claim 2, wherein the at least one processor is configured to:

measure the rate of change in the digitized electric signal converted from the amount of light reflected from the pad, and guide a user to wash or replace the pad in response to the rate of change in the digitized electric signal converted from the amount of the light reflected from the pad being changed at a preset change rate.

4. The cleaner of claim 1, wherein the at least one processor is configured to compare the digitized electric signal converted from the amount of the light reflected from the pad with a digitized electric signal converted from a reference amount of light reflection corresponding to a threshold of degradation of cleaning power to control the amount of the water sprayed by the water supplier.

5. The cleaner of claim 4, wherein the at least one processor is configured to change an amount of controlling the digitized electric signal converted from the reference amount of light reflection according to user settings.

6. The cleaner of claim 4, wherein the light source module is configured to transmit infrared light, and the at least one processor is configured to control the amount of the water sprayed by the water supplier based on the digitized electric signal converted from the amount of the light reflected from the pad being greater than the digitized electric signal converted from the reference amount of light reflection corresponding to the threshold of degradation of cleaning power.

7. The cleaner of claim 4, wherein the light source module is configured to transmit visible light, and the at least one processor is configured to control the amount of the water sprayed by the water supplier based on the digitized electric signal converted from the amount of the light reflected from the pad being smaller than the digitized electric signal converted from the reference amount of light reflection corresponding to the threshold of degradation of cleaning power.

8. A method of controlling a cleaner including a wet cloth brush to which a pad is installable so as to be below a bottom surface of the wet cloth brush, and a light source module configured to transmit light including at least one of infrared and visible light, and to convert an amount of light reflected from the pad to a digitized electric signal, the method comprising:

controlling the light source module to irradiate light to a pad installed to the wet cloth brush; and based on the digitized electric signal converted from the amount of light reflected from the pad, controlling a rotation speed of a pad motor to rotate the pad, and/or controlling an amount of water sprayed by a water supplier to a surface to be cleaned, and controlling the pad motor to increase the rotation speed as a digitized electric signal converted from the amount of the infrared light reflected from the pad during cleaning increases, and controlling the pad motor to increase the rotation speed as a digitized electric signal converted from the amount of the visible light reflected from the pad during cleaning decreases.

9. The method of claim 8, wherein the controlling of the amount of the water sprayed by the water supplier includes comparing the digitized electric signal converted from the amount of the light reflected from the pad with a digitized electric signal converted from a reference intensity of light reflection corresponding to a threshold of degradation of cleaning power.

10. The method of claim 9, further comprising:

changing an amount of controlling the digitized electric signal converted from the reference amount of light reflection according to user settings.

11. The method of claim 9, wherein the light source module is configured to transmit infrared light, and the controlling of the amount of the water sprayed by the water supplier is based on the digitized electric signal converted from the amount of the light reflected from the pad being greater than the digitized electric signal converted from the reference amount of light reflection corresponding to the threshold of degradation of cleaning power.

12. The method of claim 9, wherein the light source is module configured to transmit visible light, and the controlling of the amount of the water sprayed by the water supplier is based on the digitized electric signal converted from the amount of the light reflected from the pad being or smaller than the digitized electric signal converted from the reference amount of light reflection corresponding to the threshold of degradation of cleaning power.

* * * * *